US007992414B2

(12) United States Patent
Strait et al.

(10) Patent No.: US 7,992,414 B2
(45) Date of Patent: Aug. 9, 2011

(54) AUTOMATIC THREADING DEVICE

(75) Inventors: Michael A. Strait, Johnstown, OH (US); Michael B. Fazio, Newark, OH (US)

(73) Assignee: OCV Intellectual Capital, LLC, Toledo, OH (US)

( * ) Notice: Subject to any disclaimer, the term of this patent is extended or adjusted under 35 U.S.C. 154(b) by 469 days.

(21) Appl. No.: 11/807,055

(22) Filed: May 25, 2007

(65) Prior Publication Data

US 2008/0289367 A1 Nov. 27, 2008

(51) Int. Cl.

| | |
|---|---|
| ***C03B 37/02*** | (2006.01) |
| ***C03B 37/028*** | (2006.01) |
| ***C03B 37/03*** | (2006.01) |
| ***C03B 37/16*** | (2006.01) |

(52) U.S. Cl. ..... 65/500; 65/381; 65/486

(58) Field of Classification Search ..... 65/500, 65/381, 433, 453, 479, 486, 539; 242/148, 242/332.3

See application file for complete search history.

(56) References Cited

U.S. PATENT DOCUMENTS

| | | | | |
|---|---|---|---|---|
| 3,151,963 | A * | 10/1964 | Cochran | 65/539 |
| 4,069,984 | A * | 1/1978 | Klink et al. | 242/476.1 |
| 4,194,896 | A * | 3/1980 | Symborski et al. | 65/377 |
| 4,367,084 | A | 1/1983 | Cox et al. | |
| 4,551,160 | A | 11/1985 | Frailey et al. | |
| 5,003,855 | A | 4/1991 | Ciupak | |
| 5,970,837 | A | 10/1999 | Arterburn et al. | |
| 6,027,062 | A | 2/2000 | Bacon et al. | |
| 6,076,442 | A | 6/2000 | Arterburn et al. | |
| 6,148,640 | A | 11/2000 | Hendrickson et al. | |
| 6,202,449 | B1 | 3/2001 | Arterburn et al. | |
| 6,267,035 | B1 | 7/2001 | Bascom et al. | |
| 6,453,704 | B2 | 9/2002 | Arterburn et al. | |
| 2004/0016093 | A1 | 1/2004 | Lueneburger et al. | |

FOREIGN PATENT DOCUMENTS

| | | |
|---|---|---|
| FR | 2 876 392 | 4/2006 |

OTHER PUBLICATIONS

International Search Report dated Oct. 22, 2008 in PCT/US2008/064033.

Communication from European Application No. 08755813.6 dated Oct. 5, 2010.

Office action from Chinese Application No. 200880017465.0 dated Nov. 15, 2010.

* cited by examiner

*Primary Examiner* — Matthew J Daniels
*Assistant Examiner* — Cynthia Szewczyk
(74) *Attorney, Agent, or Firm* — Calfee, Halter & Griswold LLP

(57) ABSTRACT

A strand forming and chopping apparatus includes a bushing for forming a continuous strand, a size applicator for applying a size to the strand, a chopping device for chopping the strand into individual segments and a thread-up apparatus for directing the strand into the chopping device. The thread-up apparatus includes a cot incorporating a cot shoe and a strand guide displaceable between a rest position and a thread-up position where the strand guide holds the strand in a feed position from which the strand is engaged by the cot shoe and delivered to the chopping device.

17 Claims, 12 Drawing Sheets

AUTOMATIC THREADING DEVICE

TECHNICAL FIELD AND INDUSTRIAL APPLICABILITY OF THE INVENTION

This invention relates generally to the field of strand forming and chopping and, more particularly, to an apparatus and method for threading a strand in a strand forming and chopping apparatus.

BACKGROUND OF THE INVENTION

A strand of glass filaments is typically formed by attenuating molten glass through a plurality of orifices and a bottom plate of a bushing. The filaments are attenuated by applying tractive forces to the streams of glass, so as to attenuate the streams. The filaments are coated with a size or binder material which serves to provide a lubricating quality to the individual filaments to provide them with abrasion resistance. The glass filaments are sized with the size material substantially immediately after they are formed. The filaments are gathered in parallel relationship to form a strand.

The continuous strand is then fed to a chopping device where it is cut into individual segments of a desired length. The present invention relates to a strand forming and chopping apparatus, a thread-up apparatus for directing a strand into a chopping device and a method of threading a strand in a strand forming and chopping apparatus. The apparatus and method allow for robust, automatic thread-up, are extremely efficient and allow for ergonomic operation to the benefit of the operator. The apparatus and method may be used with a single position chopper.

SUMMARY OF THE INVENTION

In accordance with the purposes of the present invention as described herein, a strand forming and chopping apparatus is provided. The strand forming and chopping apparatus comprises a bushing for forming a continuous strand, a size applicator for applying a size to the strand, a chopping device for chopping the strand into individual segments and a thread-up apparatus for directing the strand into the chopping device. The thread-up apparatus includes (a) a cot assembly including a cot shoe and (b) a strand guide displaceable between a rest position free from said strand and a thread-up position where the strand guide holds the strand in a feed position in which the strand is engaged by the cot shoe and delivered to the chopping device. The cot includes a recess and a portion of the cot shoe is received and held in that recess. Further, the cot includes a beveled edge.

The apparatus further includes a thread-feeding device including a thread-up shoe carried on an extensible arm which may take the form of a linear motion device such as a pneumatic cylinder, a hydraulic cylinder, or a linear actuator driven by air or electro mechanical means. The thread-feeding device is displaceable between a home position and a threading position wherein the thread up shoe positions the strand in a thread position for engagement by the strand guide.

Still further describing the invention, the apparatus includes a product chute and a product chute door displaceable between an open position and a closed position. The apparatus also includes a main idler for the strand provided between the size applicator and the cot. Pull-up rolls are also provided for engaging the strand and positioning the strand for engagement with the thread-up shoe.

In accordance with yet another aspect of the present invention a thread-up apparatus is provided for directing a strand into a chopping device. The thread-up apparatus comprises a cot including a cot shoe and a strand guide displaceable between a first position free from said strand and a second position where the strand guide holds the strand in a feed position in which the strand is engaged by the cot shoe and delivered to the chopping device.

Still further, the apparatus includes a thread-feeding device including a thread-up shoe carried on an extensible arm. The thread-feeding device is displaceable between a home position and a threading position wherein the thread-up shoe positions the strand in a thread position for engagement by the strand guide.

In accordance with still another aspect of the current invention, a method is provided of threading a strand in a strand forming and chopping apparatus. That apparatus includes a bushing, pull rolls, a guide shoe, a main idler, a product chute, a product chute door and a chopping device. The method comprises the steps of placing the strand in the pull rolls, engaging the strand with a thread feeding device and moving the strand to a thread position where the strand engages the main idler. Next is the step of engaging the strand at the thread position with a strand guide and moving the strand into a feed position. This is followed by the grabbing of the strand in the feed position with a cot shoe carried on a rotating cot and the pulling of the strand around the cot into the chopping device.

The method may be further described as including the steps of extending an extensible arm of the thread feeding device in order to engage the strand, retracting the extensible arm following the strand being pulled into the chopping device and moving the main idler from a thread-up position to an operating position. Still further the method includes the steps of increasing the speed of the cot after the strand is pulled by the cot into the chopping device and opening the product chute door after the strand is being chopped into individual segments by the chopping device. Still further the method includes the steps of rotating the guide chute from a single oscillator position to a multi-split position and returning the strand guide to a home position free of the strand once the strand has been pulled into and received in the chopping device.

In the following description there is shown and described a preferred embodiment of the invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated herein and forming a part of the specification, illustrate several aspects of the present invention and together with the description serves to explain certain principles of the invention. In the drawings.

Reference will now be made in detail to the present preferred embodiment of the invention, an example of which is illustrated in the accompanying drawings.

DETAILED DESCRIPTION AND PREFERRED EMBODIMENTS OF THE INVENTION

Figure 1:
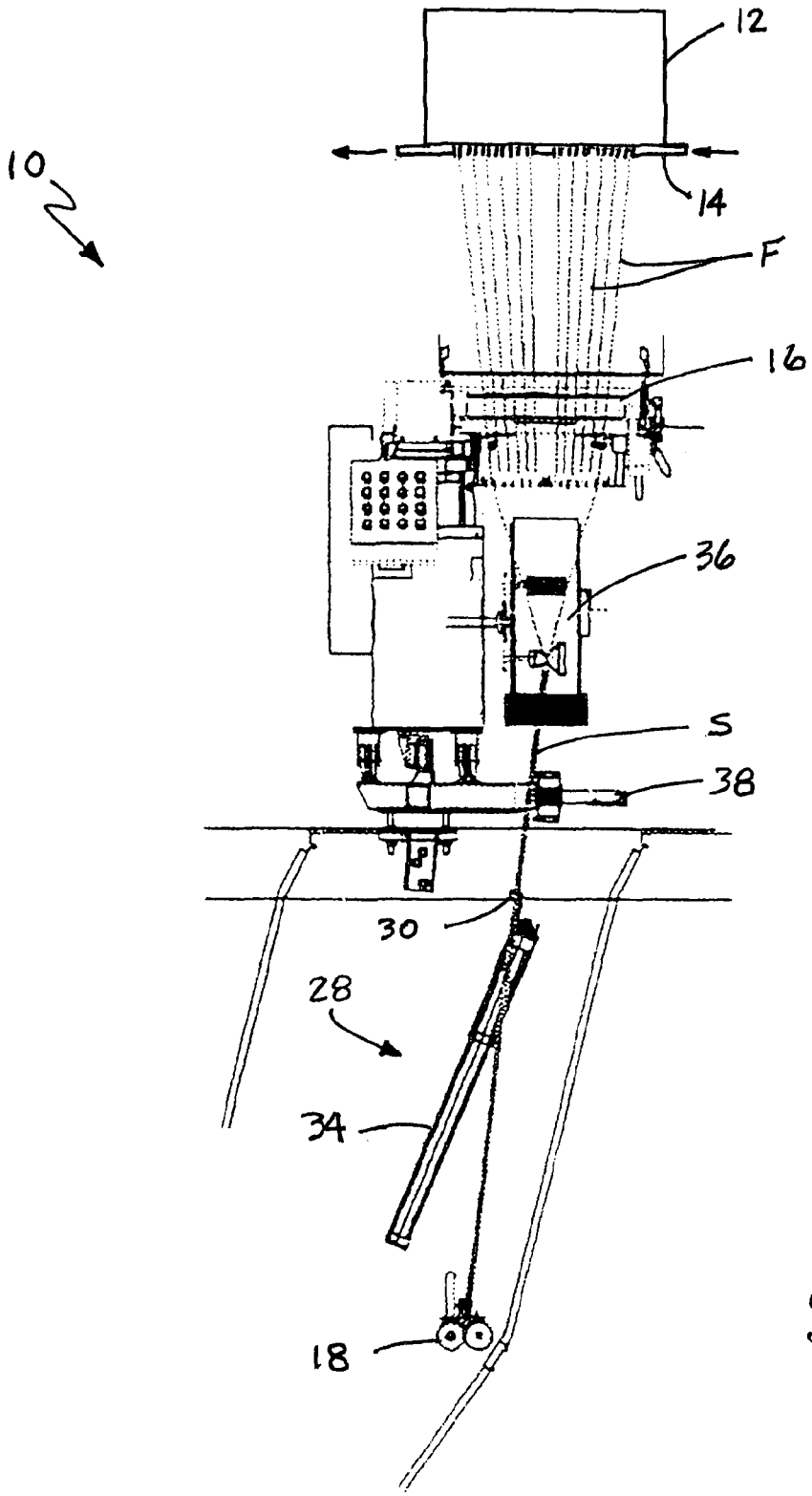
FIG. 1 is a schematical front elevational view of the strand forming and chopping apparatus of the present invention illustrating the formed filaments and strand extending from the bushing through the size applicator to the pull rolls.
Figure 2:
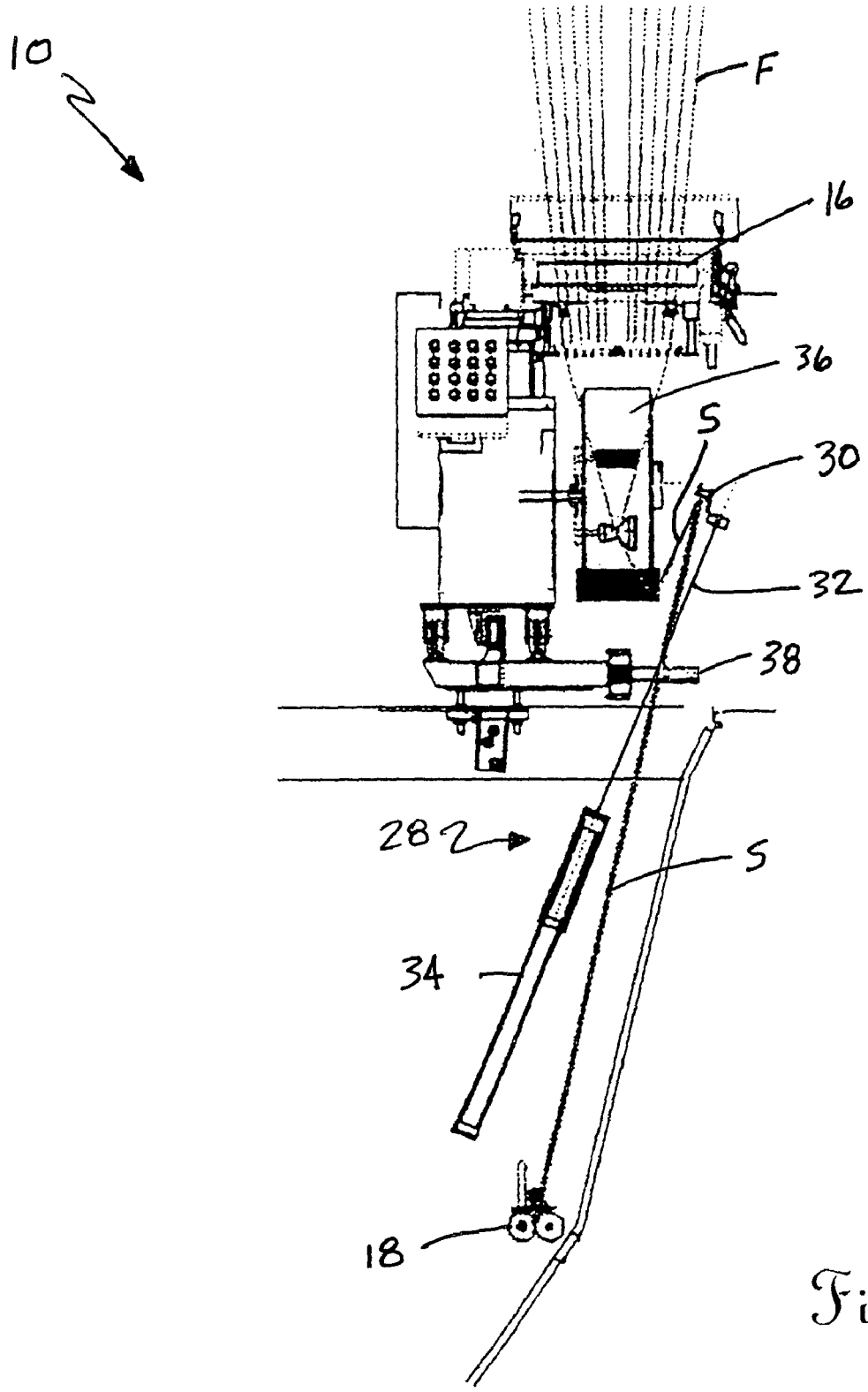
FIG. 2 is a view similar to FIG. 1 illustrating the extension of the thread feeding device.
Figure 3:
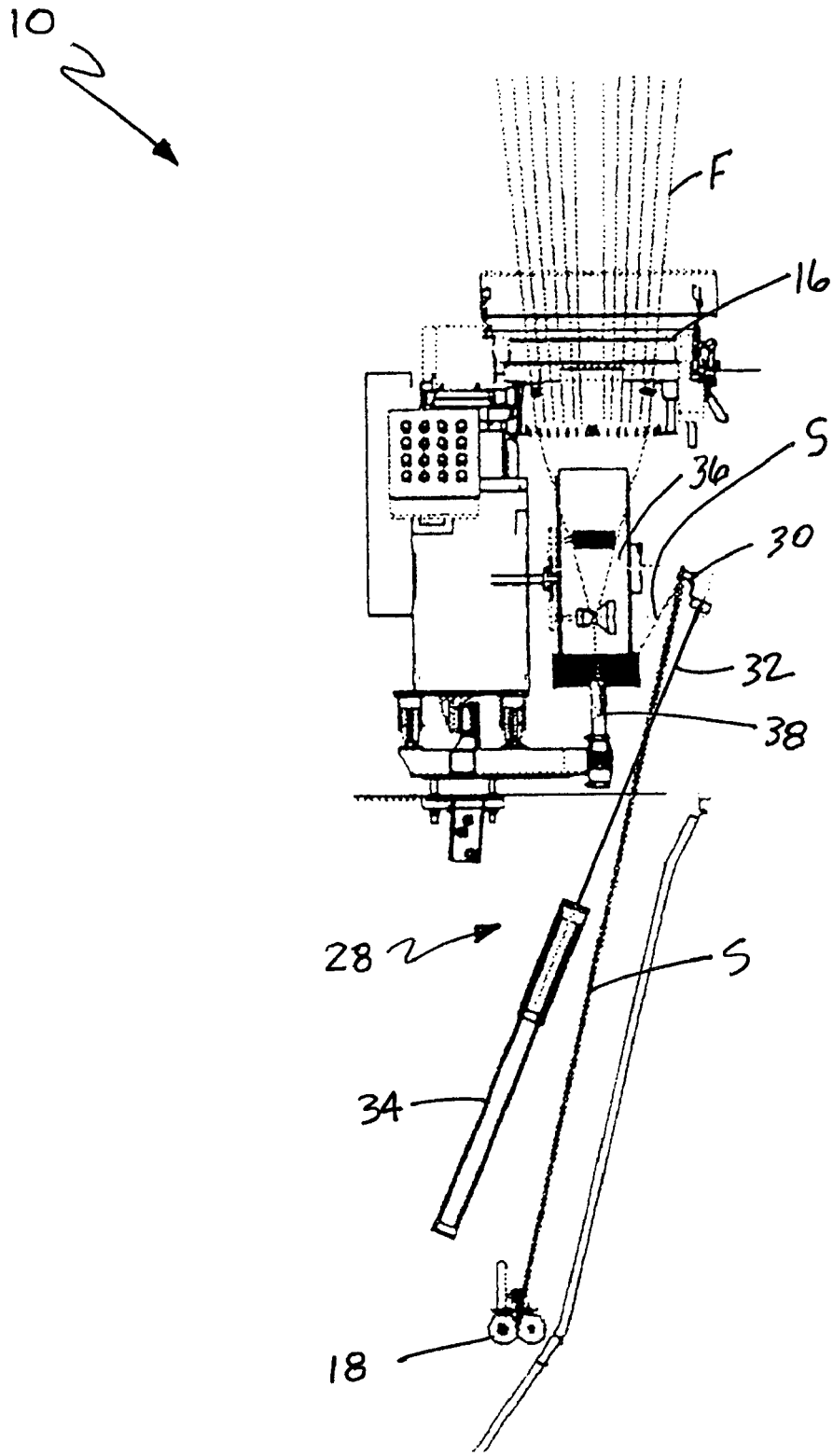
FIG. 3 is a view similar to FIGS. 1 and 2 but illustrating the displacement of the strand guide to hold the strand in a feed position from which the strand is engaged by the cot shoe.

Reference is now made to FIG. 1-3 generally illustrating the strand forming and chopping apparatus 10 of the present invention. The apparatus includes a bushing 12 having a number of orifices through which a plurality of streams of molten glass are discharged. The orifices may be extended by hollow tips. Since the bushing 12 operates at high temperatures, a cooling system 14 is used to control the temperature of the bushing bottom plate and prevent any variance in the filaments F due to a temperature gradient. It should be appreciated that the cooling system 14 may use air and/or water to control the temperature. The filaments F pass over a size applicator 16 which applies a liquid coating or size material to the filaments F. The filaments F are then drawn into a strand S.

A downward force is applied to pull the filaments F from the bushing 10. During the thread-up operation, the downward force is first applied by the pull rolls 18. During normal apparatus operation the downward force is applied by a cot 36 and/or the chopping device 20. The downward force functions to attenuate the filaments F and the strand S in a manner well known in the art so as to form the filaments F and strand S with a desired diameter.

Figure 4A:
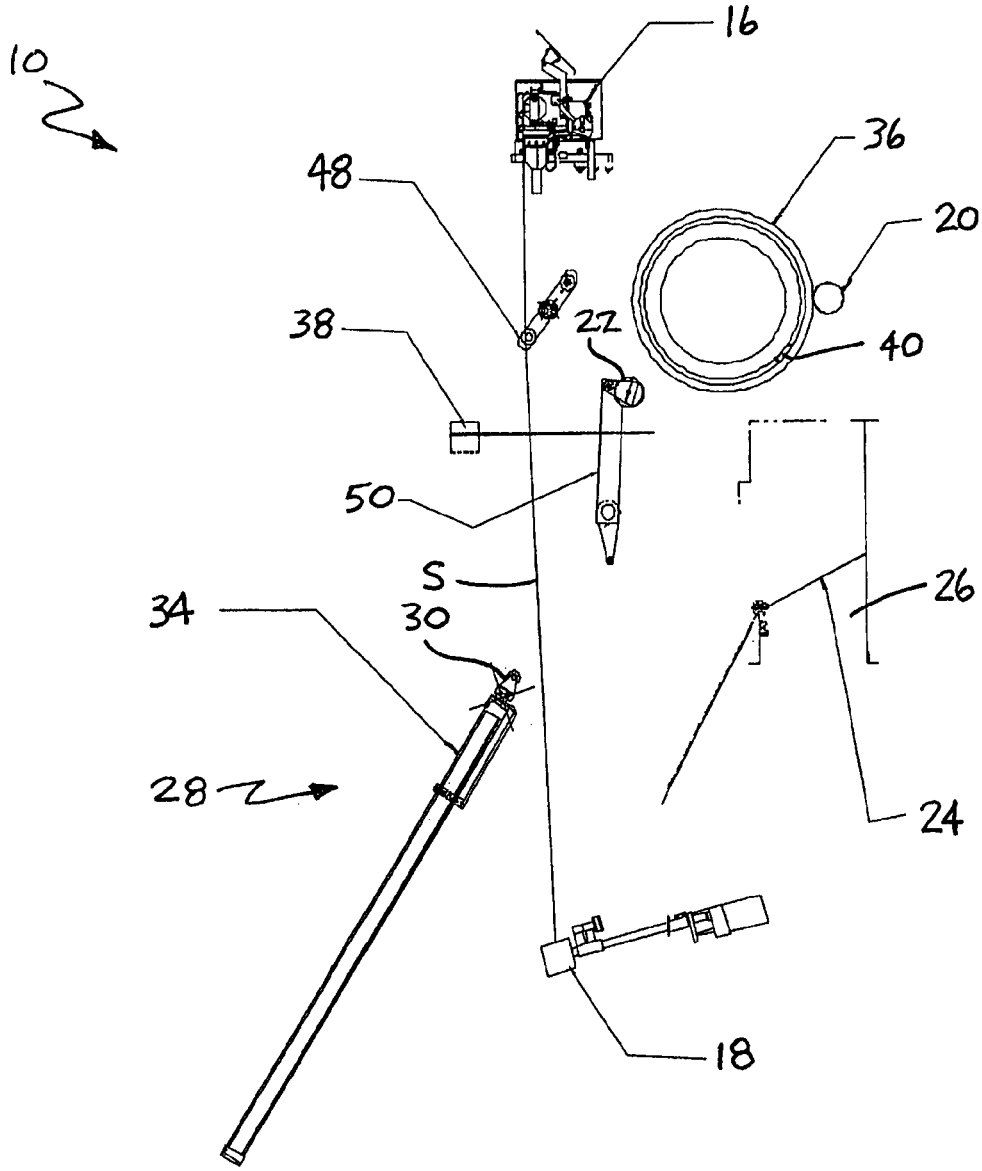
FIGS. 4*a*-4*h* are schematical figures illustrating step-by-step the present method of threading a strand in a strand forming and chopping apparatus.

The process or method of threading a strand S in the strand forming and chopping apparatus 10 will now be described in detail with reference to the drawing FIGS. 4*a*-4*h*. As best illustrated in FIGS. 1 and 4*a*, the start up sequence begins with the operator placing the free end of the strand S in the pull rolls 18 located down on the winder level. At this point in the process, the articulated main idler 22 is in the raised or "thread-up" position in order to provide at least 200 degrees of strand wrap on the cot 36 (note, for example, FIG. 4*e* showing strand S on cot 36 over an arc of about 200 degrees). In addition the product chute door 24 is closed thereby closing the product chute 26. The thread feeding device 28 is then activated. The thread feeding device 28 comprises a thread-up shoe 30 carried on an extensible arm 32. The thread feeding device 28 may take the form of a linear motion device selected from a group consisting of a pneumatic cylinder, a hydraulic cylinder, or a linear actuator driven by air or electro-mechanical means. For purposes of illustration, a pneumatic cylinder 34 is illustrated in the drawing figures.

Figure 4B:
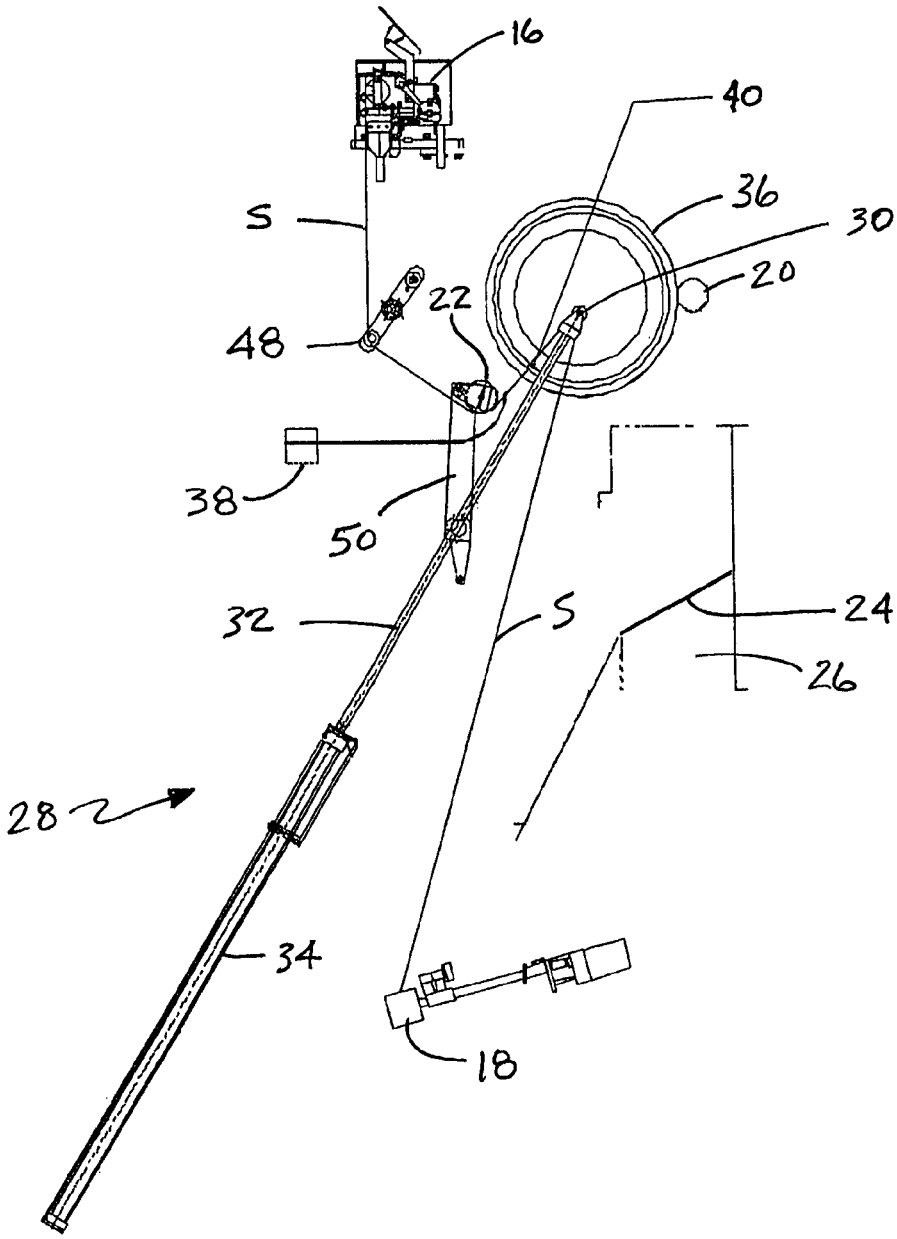
Figure 4C:
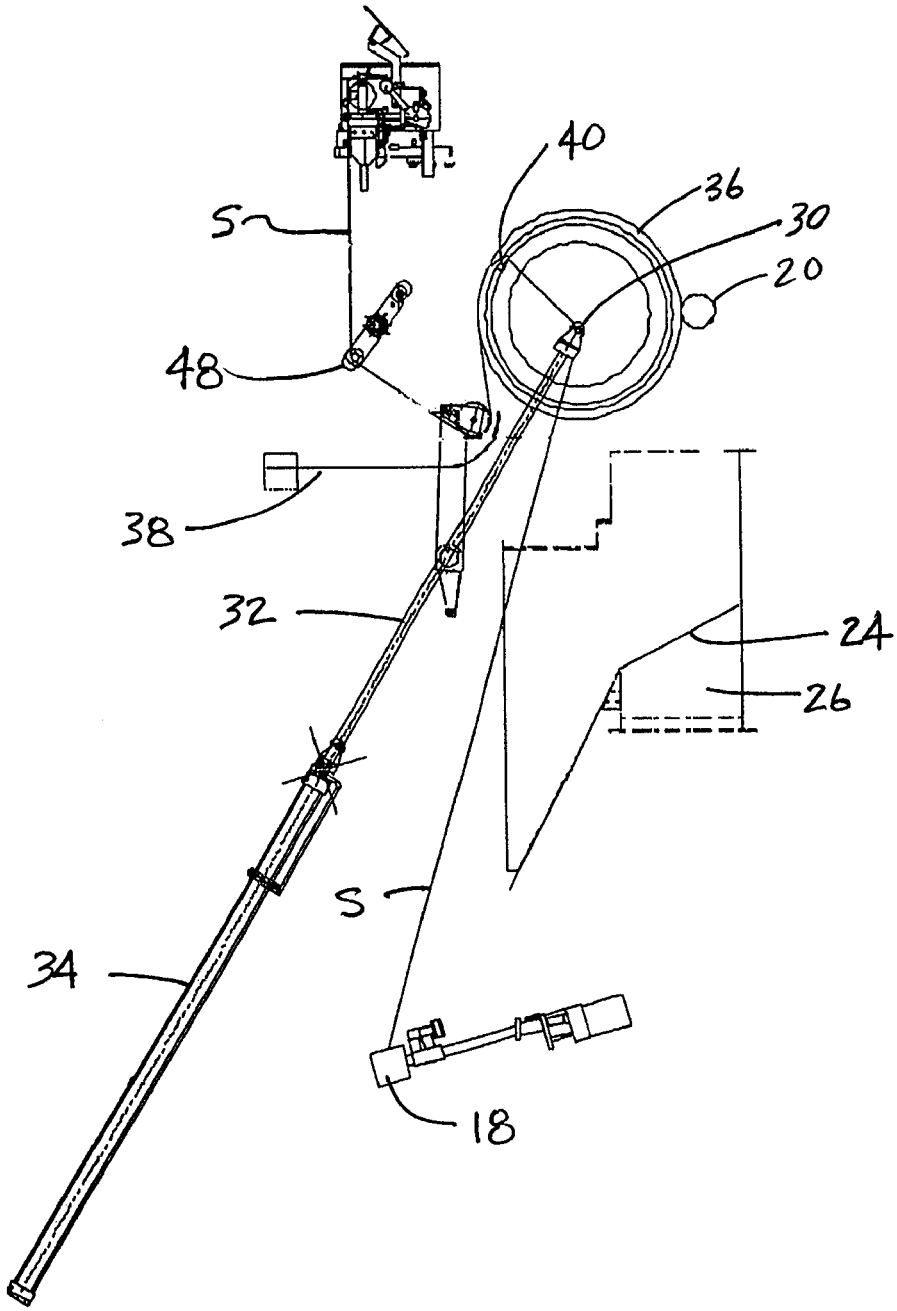
Figure 4D:
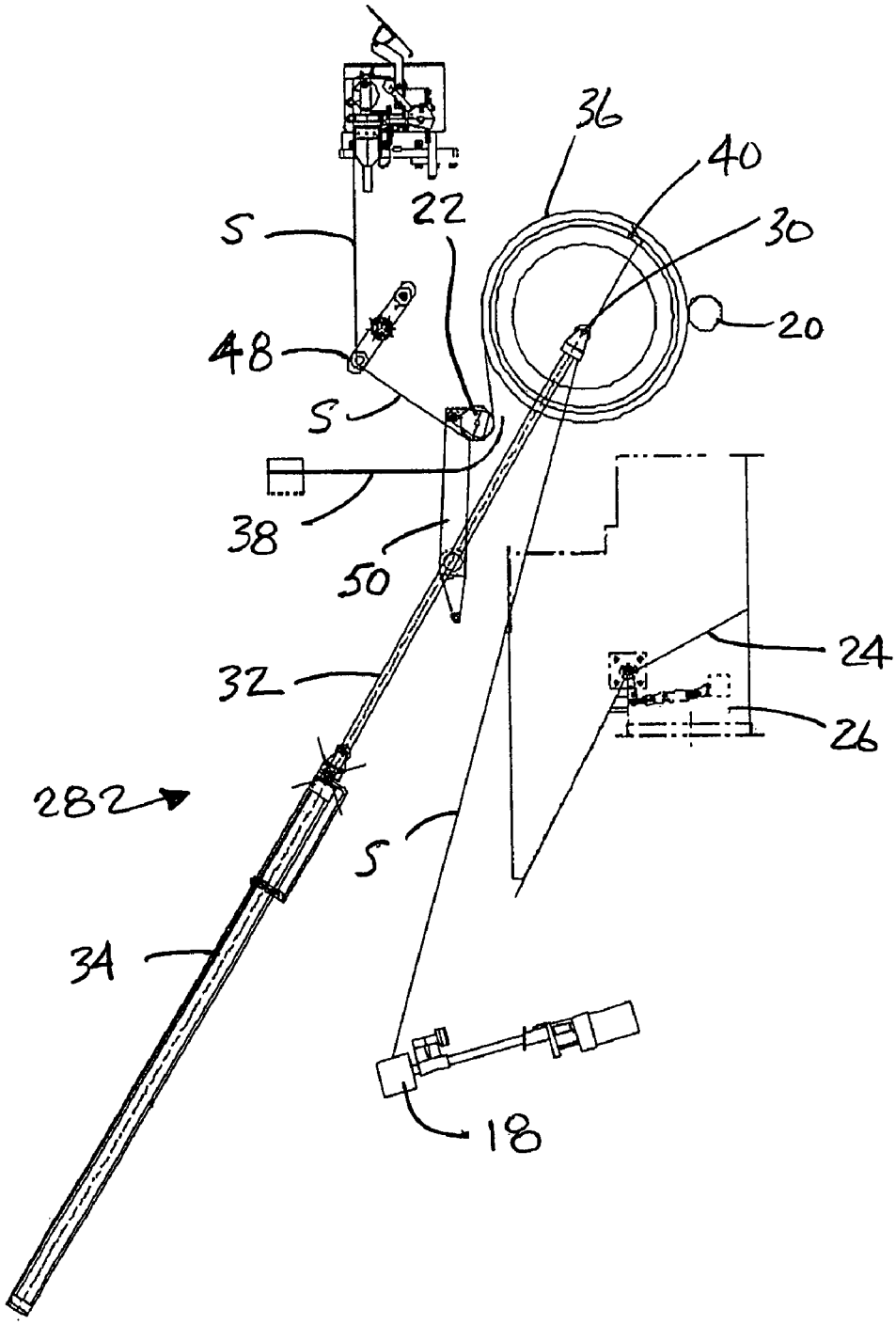
Figure 4E:
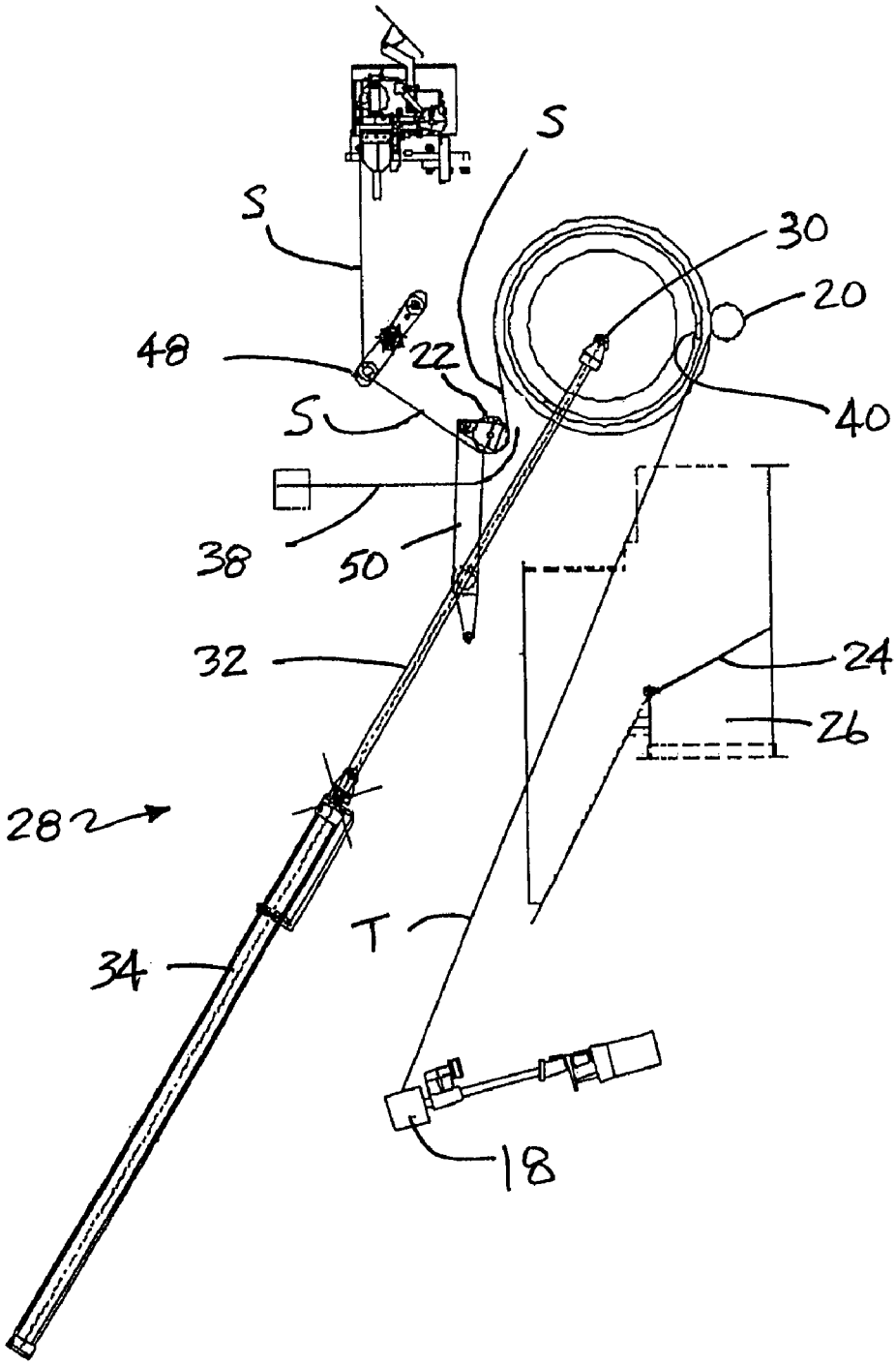
Figure 4F:
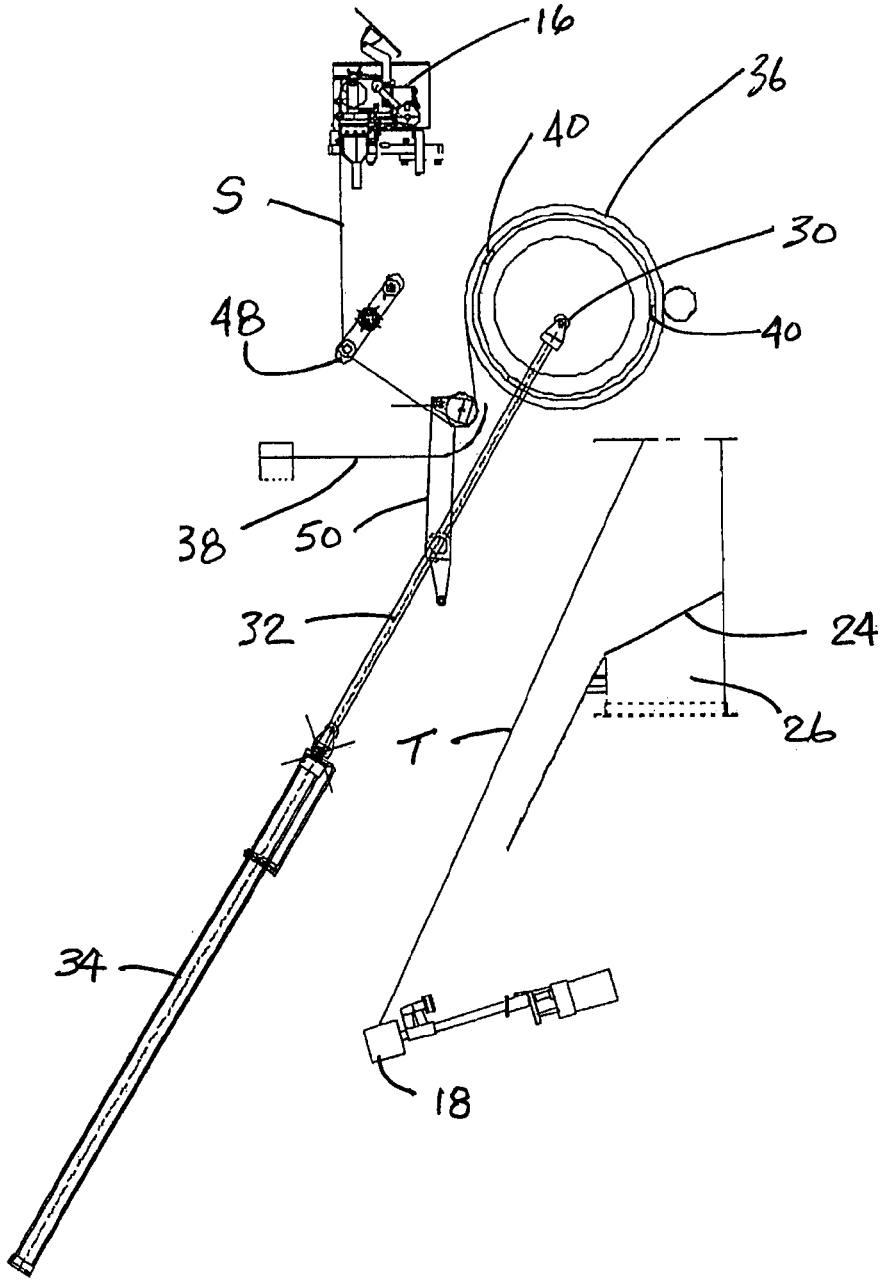
Figure 4G:
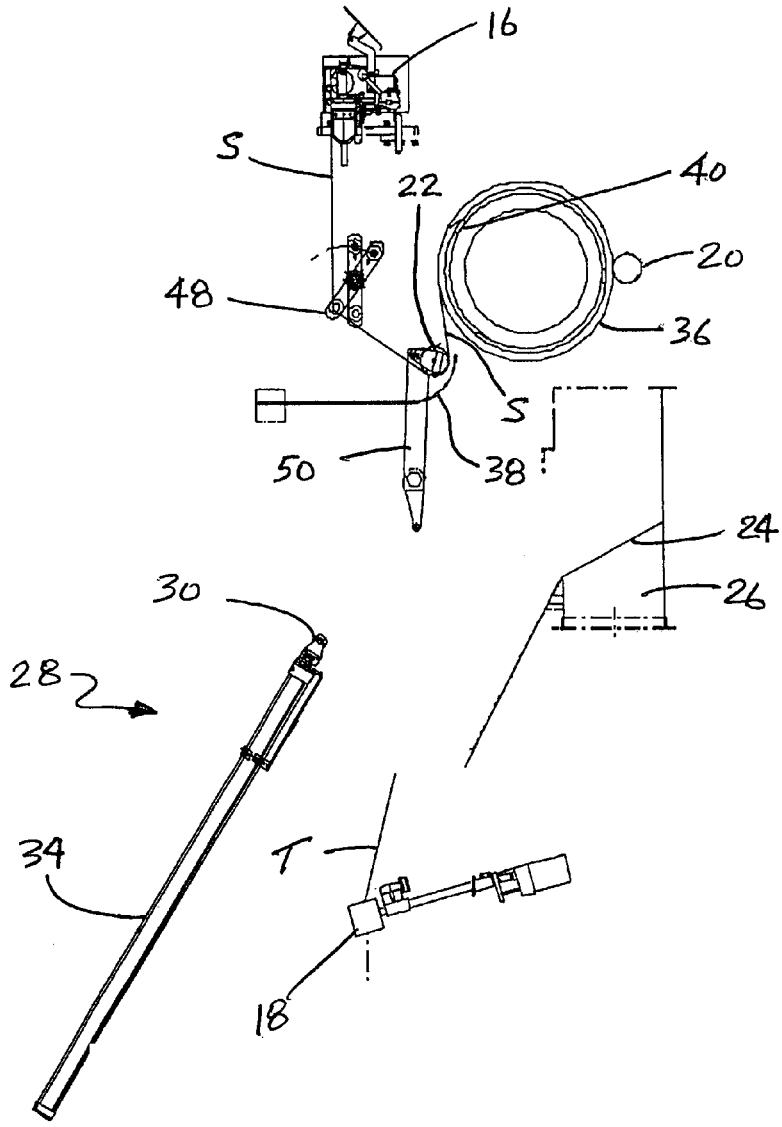
Figure 4H:
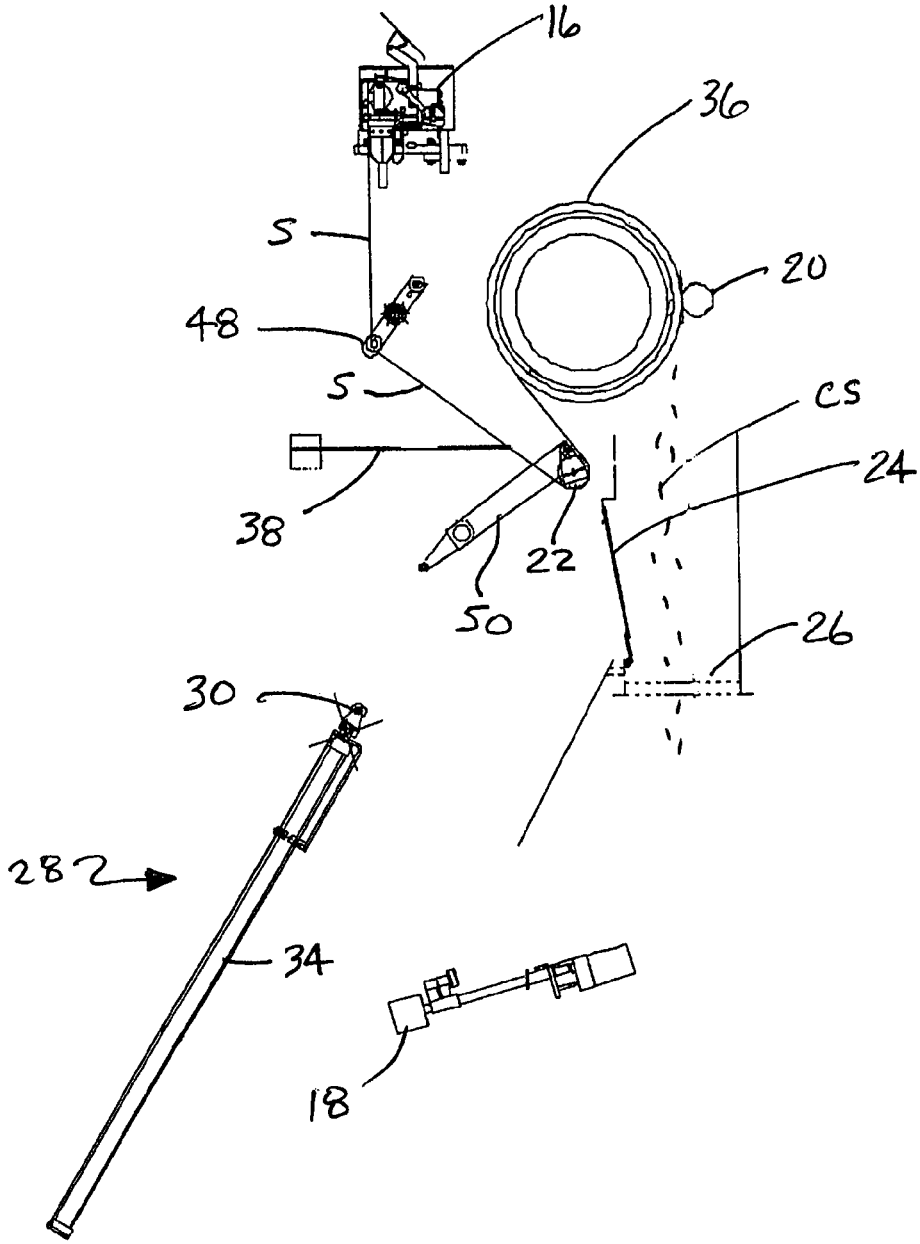

As illustrated in FIGS. 2 and 4*b*, the thread-up shoe 30 of the thread feeding device 28 engages the strand S and moves the strand toward the centerline or rotary axis of the cot 36 so that the strand is held in a thread position with the strand engaging the main idler 22. As the extensible arm 32 reaches the end of its stroke, a strand guide 38 is displaced from its first or rest position illustrated in FIGS. 1, 2 and 4*a* to its second or thread-up position illustrated in FIGS. 3 and 4*b*. In the thread-up position, the strand guide 38 functions to hold the strand S in a feed position where the strand may be engaged by a cot shoe 40 carried on the cot 36. The cot shoe 40 may be made from a laminated plastic, such as sold under the trademark MICARTA, or other appropriate material.

Figure 5:
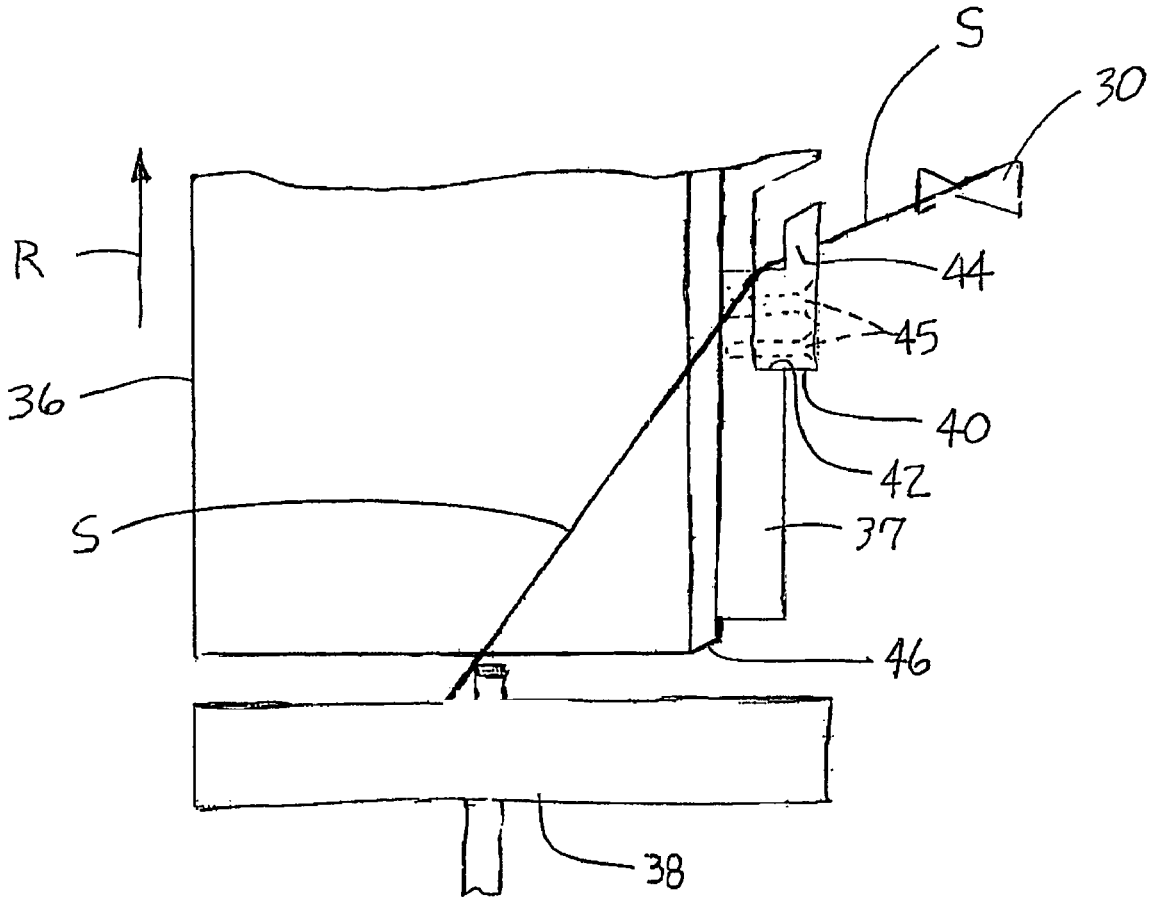
FIG. 5 is a detailed top plan view illustrating the cot, the cot shoe and the beveled edge of the cot.

More specifically, as best illustrated in FIG. 5, the cot assembly 36 includes a housing 37 having a recess 42. At least a portion of the cot shoe 40 is received in the recess. Fasteners 45 may be utilized to secure the cot shoe 40 in the recess 42 with a portion of the cot shoe 40 projecting from the cot 36 so as to form a lug or tooth 44. When in the feed position, the strand S is held in the path of the cot shoe 40. Thus, as the cot 36 is rotated (note direction of rotation illustrated by action arrow R) at a reduced or thread-up speed of between about 150 fpm and about 3000 fpm, the tooth 44 engages the strand S and the cot 36 begins pulling the strand around and over the cot toward the chopping device 20. The beveled edge 46 of the cot 36 protects the strand from being cut by the cot as it is pulled toward the chopping device 20. Simultaneously, the strand guide 38 functions to direct the strand S toward the center of the radial surface of the cot 36 (see also FIGS. 4*c* and 4*d*).

As best illustrated in FIG. 4*e*, the strand S is eventually pulled through the chopping device 20 where the tail T is severed from the strand S. The tail T is the portion of the strand S shown in FIG. 4*e* extending between the chopping device 20 and the pull rolls 18. The tail T is drawn off to scrap by the pull rolls 18 and away from the product chute 26 (see FIG. 4*f*). The apparatus 10 now pauses for a defined period of time to allow the operator to rotate the guide shoe 48 from the single oscillator to the multi-split position (see FIG. 4*g*). The ends of the splits are then aligned in the splitter shoe 38 and on the cot 36. This action ensures that no product gets into the finished product having the wrong TEX or diameter. Next the strand guide 38 is returned to the rest position and the main idler 22 is pivoted down into the operating position on the arm 50. The cot 36 is then accelerated to normal run speed of between about 2500 fpm and about 7000 fpm.

As the cot 36 accelerates the chute door 24 remains closed to prevent the chopped product from falling down the product chute 26. Consequently the initial chopped product is sent to scrap with the tail end T of the strand S (see FIG. 4*h*). Once the cot 36 reaches operating speed the product chute door 24 opens so that the chopped strand CS from the chopping device 20 is sent through the product chute 26 to the production line (see FIG. 4*h*). Of course, this thread-up method is repeated as necessary in order to thread a strand S into the chopping device 20.

The foregoing description of the preferred embodiments of the present invention have been presented for purposes of illustration and description. It is not intended to be exhaustive or to limit the invention to the precise form disclosed. Obvious modifications or variations are possible in light of the above teachings. The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiments do not and are not intended to limit the ordinary meaning of the claims in their fair and broad interpretation in any way.

What is claimed:

1. A strand forming and chopping apparatus, comprising:

a bushing for forming a continuous strand;

a size applicator for applying a size to said strand;

a chopping device for chopping said strand into individual segments; and a thread up apparatus for directing said strand into said chopping device, said thread up apparatus including:

(a) a cot including a cot shoe;

(b) a strand guide displaceable between a rest position wherein said strand guide is free from said strand and a thread up position wherein said strand guide holds said strand in a feed position from which said strand is engaged by said cot shoe and delivered to said chopping device; and (c) a thread feeding device including a thread up shoe carried on a linearly extensible arm, said thread feeding device being linearly displaceable between a home position and a threading position wherein said thread up shoe positions said strand in a thread position for engagement by said strand guide, wherein said home position is further from a rotary axis of said cot than said threading position, wherein said strand guide is in said rest position if said linearly extensible arm is in said home position, and wherein said strand guide is in said thread up position if said linearly extensible arm is in said threading position.

2. The apparatus of claim 1, wherein said extensible arm is a linear motion device selected from a group consisting of a pneumatic cylinder, a hydraulic cylinder, or a linear actuator driven by air or electro-mechanical means.

3. The apparatus of claim 1, further including a product chute and a product chute door displaceable between an open position and a closed position.

4. The apparatus of claim 1, further including an articulated main idler for said strand provided between said size applicator and said cot capable of being positioned in a thread up position and a running position which provides at least 200 degrees of strand wrap on said cot.

5. The apparatus of claim 1, further including pull rolls for engaging said strand and positioning said strand for engagement with said thread up shoe, wherein said thread up shoe is carried on said extensible arm.

6. The apparatus of claim 1, wherein said cot assembly includes a recess and a portion of said cot shoe is received and held in said recess, wherein a second portion of said cot shoe projects from said cot to form a tooth.

7. The apparatus of claim 6, wherein said cot includes a beveled edge, wherein said beveled edge protects said strand from breaking while said strand is in said feed position.

8. A thread up apparatus for directing a strand into a chopping device, comprising:

a cot assembly including a cot shoe;

a strand guide displaceable between a first position wherein said strand guide is free from said strand and a second position wherein said strand guide holds said strand in a feed position from which said strand is engaged by said cot shoe and delivered to said chopping device; and a thread feeding device including a thread up shoe carried on a linearly extensible arm, said thread feeding device being linearly displaceable between a home position and a threading position wherein said thread up shoe positions said strand in a thread position for engagement by said strand guide, wherein said home position is further from a rotary axis of said cot assembly than said threading position, wherein said strand guide is in said rest position if said linearly extensible arm is in said home position, and wherein said strand guide is in said thread up position if said linearly extensible arm is in said threading position.

9. The apparatus of claim 8, wherein said cot assembly includes a recess and a portion of said cot shoe is received and held in said recess, wherein a second portion of said cot shoe projects from said cot to form a tooth.

10. The apparatus of claim 9, wherein said cot includes a beveled edge, wherein said beveled edge protects said strand from breaking while said strand is in said feed position.

11. A method of threading a strand in a strand forming and chopping apparatus, including a bushing, pull rolls, a guide shoe, an articulated main idler, a product chute, a product chute door and a chopping device, said method comprising:

placing said strand in said pull rolls;

engaging said strand with an extensible thread feeding device and moving said strand into a thread position wherein said strand engages said articulated main idler;

engaging said strand at said thread position with a strand guide and linearly moving said strand into a feed position;

grabbing said strand in said feed position with a cot shoe carried on a rotating cot; and pulling said strand around said cot and into said chopping device, wherein engaging said strand with said extensible thread feeding device includes linearly extending an arm of said extensible thread feeding device from a home position to a threading position, wherein engaging said strand with said strand guide includes moving said strand guide from a rest position wherein said strand guide is free from said strand to a thread up position wherein said strand guide holds said strand in said feed position, wherein said home position is further from a rotary axis of said rotating cot than said threading position, wherein said strand guide is moved to said rest position if said linearly extensible arm is in said home position, and wherein said strand guide is moved to said thread up position if said linearly extensible arm is in said threading position.

12. The method of claim 11, including retracting said linearly extensible arm following said strand being pulled into said chopping device.

13. The method of claim 12, including moving said articulated main idler from a thread up position to an operating position.

14. The method of claim 13, including opening said product chute door after said strand is being chopped into individual segments by said chopping device.

15. The method of claim 11, including increasing speed of rotation of said cot after said strand is pulled by said cot into said chopping device.

16. The method of claim 11, including rotating said guide shoe from a single oscillator position to a multi-split position after said strand is pulled into said chopping device.

17. The method of claim 11, including returning said strand guide to a rest position after said strand is pulled into said chopping device.

* * * * *